United States Patent [19]

Berker

[11] Patent Number: 4,821,900

[45] Date of Patent: Apr. 18, 1989

[54] PROCESS FOR IMPREGNATING CORKS

[76] Inventor: Otto Berker, Riedgasse 29, Innsbruck, Austria

[21] Appl. No.: 170,034

[22] Filed: Mar. 21, 1988

Related U.S. Application Data

[63] Continuation of Ser. No. 857,128, Apr. 29, 1986, abandoned.

[30] Foreign Application Priority Data

May 9, 1985 [DE] Fed. Rep. of Germany ..... 3516633

[51] Int. Cl.[4] ..... B05D 3/06; B05D 3/00; B65D 39/00

[52] U.S. Cl. ..... 215/355; 427/40; 427/325; 204/165

[58] Field of Search ..... 427/40, 325; 204/165; 215/355

[56] References Cited

U.S. PATENT DOCUMENTS

| | | | |
|---|---|---|---|
| 377,928 | 2/1888 | Carmichael | 427/325 |
| 663,234 | 10/1900 | Le Franc | 427/325 |
| 1,256,200 | 2/1918 | Carver | 427/325 |
| 3,262,808 | 7/1966 | Crooks et al. | 427/40 |
| 3,317,339 | 5/1967 | Fortner et al. | 427/223 |
| 3,415,683 | 12/1968 | Coffman et al. | 427/40 |
| 3,445,265 | 5/1969 | Bentley et al. | 427/325 |
| 3,600,122 | 8/1971 | Coleman | 427/40 |
| 3,817,701 | 6/1974 | Thorsen | 204/165 |
| 4,298,440 | 11/1981 | Hood | 204/165 |

FOREIGN PATENT DOCUMENTS

| | | | |
|---|---|---|---|
| 8547995 | 9/1985 | Australia . | |
| 801785 | 8/1936 | France | 215/355 |
| 791776 | 3/1958 | United Kingdom | 204/165 |

OTHER PUBLICATIONS

J. F. Hughes, *Electrostatic Powder Coating,* John Wiley & Sons Inc., New York 1984 pp. 1–2.

C. W. Theron, et al., *The Evaluation of Corks,* 1983.

*Primary Examiner*—Norman Morgenstern
*Assistant Examiner*—Marianne L. Padgett
*Attorney, Agent, or Firm*—Gifford, Groh, Sheridan, Sprinkle and Dolgorukov

[57] ABSTRACT

A process for impregnating corks, in such a way as to improve the sealing effect thereof, with at least one substance which is repellent to aqueous solutions and which is comparable or identical to aqueous solution-repellent substances naturally occurring in cork, in regard to sealing effect and compatibility with the material to be sealed in a container by the cork, provides that prior to the impregnation step on a surface thereof which is to be impregnated the cork is exposed to direct current corona discharge or an alternating current corona discharge, thereby enhancing the capacity of the cork to absorb the impregnation agent.

32 Claims, No Drawings

PROCESS FOR IMPREGNATING CORKS

This is a continuation of co-pending application Ser. No. 857,128, filed on Apr. 29, 1986 now abandoned.

BACKGROUND OF THE INVENTION

The present invention relates generally to a process for impregnating corks for use in bottles or like containers, in such a way as to improve the sealing action thereof.

When storing liquids such as and more particularly wines and spirits in bottles or like containers which are closed by means of a cork, it is relatively frequently observed that the cork becomes partly or completely soaked with the liquid in the bottle. Ultimately such wetting of the cork can also result in the liquid slowly leaking from the bottle. Particularly when the liquid contained in the bottle is wine, such wetting of the cork, due to accompanying oxidation phenomena and exchange diffusion of substances between the cork and the wine, may result in undesired variations in the taste of the wine and ultimately may result in the wine having to be prematurely dumped.

The structure of cork is in substance comparable to that of a closed-pore foam material. In both cases, the cells or the pores are filled with air or gas and the cell volume is sealed off relative to adjacent cell volumes by the walls of the cell structure. The main constituents of the cell walls are wood and cellulose (about 30%), water (about 10%) and water-repellent substances (about 57.5%). The water-repellent substances are primarily in the form of saturated and unsaturated fatty acids. In addition there are also primary alcohols having from 20 to 26 carbon atoms and alkanes having from 16 to 34 carbon atoms (see for example Stazione Sperimentale Del Sughero Tempio Pausanio, ANTONIO PES, 'UN ULTERIORE CONTRIBUTO ALLA CONOSCENZA DELLE CARATTERISTICHE CHIMICO FISICHE DEL SUGHERO AL FINI DEL SUO IMPIEGO IN ENOLOGIA' (translation: A FURTHER CONTRIBUTION TO KNOWLEDGE OF THE CHEMICAL-PHYSICAL CHARACTERISTICS OF CORK FOR THE PURPOSES OF USE THEREOF IN OENOLOGY), taken from No 12 of 'Enotecnico' 1977, 2nd edition, ASSOCIAZIONE ENOTECNICI ITALIANI, Italian Section of the Union Internationale des Oenologues (International Union of Oenologists), Viale Murillo, 17-20149 Milan).

On the basis of investigations which are now verified (see STAZIONE SPERIMENTALE DEL SUGHERO, Settore Chimico-Technologico, TEMPIO PAUSANIO, COLLANA TECNOLOGICA, No 13, ANTIONIO PES, Criteri di scelta dei turaccioli di sughero per l'imbottigliamento di vini pregiati, (translation: CRITERIA FOR THE SELECTION OF CORK STOPPERS FOR BOTTLING VALUABLE WINES), SASSARI TIP. GALLIZZI, 1980), in order to attain a long-term sealing action in respect of a cork in the neck of a bottle, it is necessary for about 300 g of water-repellent substance (hereinafter referred to simply as 'fatty acid' as the typical main constituent) to be present per liter of volume occupied by the cork in the neck of the bottle, more particularly in the region of the side of the cork which is towards the wine. With such a fatty acid content in the cork compressed in the neck of the bottle, it is possible reliably to prevent the cork from becoming soaked by the wine even when it is stored for many years. In theory, it is always possible to achieve that value by suitable selection of the degree of compression of the cork and the contact pressure produced thereby, that is to say by suitably selecting the ratio between the diameter of the cork prior to being put into the neck of the bottle, and the diameter of the neck of the bottle. In practice however there are limits. Existing bottling plants can frequently only handle corks which are up to 25 mm in diameter. The diameters of the necks of bottles are generally in the range of from 18 to 20 mm and taper outwardly by a further 1 to 2 mm at a 40 mm depth (which is the typical length of cork). There is therefore an upper limit, defined by technical considerations, in respect of the maximum degree of cork compression that can be achieved. In addition, from the aspect of the bottle also, there is an upper limit set in respect of the maximum permissible degree of compression of the cork in the neck of a bottle as, with excessively high levels of cork compression, the internal pressure which is instantaneously built up in the operation of fitting the cork cannot decrease again and thus results in the bottle breaking. Certain shapes of bottle, in particular the box bag shape, are particularly sensitive in that respect.

Because of the upper limit, which is set by technical factors, in regard to the maximum permissible degree of cork compression in the neck of a bottle, the above-mentioned amount of 300 g of fatty acid per liter of volume occupied by the cork in the neck of the bottle, and thus a reliable long-term sealing effect, can only be achieved with corks which are of higher quality. High quality in this context denotes cork from a slowly grown cork bark with an annual ring spacing of about 2 mm, a correspondingly fine cell structure and a high weight. Lower-grade qualities of cork come from cork barks which are grown more quickly, with a correspondingly coarser annual ring spacing, coarser cell structure and lower gravity. On the other hand, irrespective of the specific weight of the cork, the fatty acid always occurs at a value of 57.5% in the cork; therefore this involves a higher degree of compression for a low-grade cork than for a high-grade cork in order to arrive at the above-indicated amount of 300 g of fatty acid per liter of volume occupied by the cork in the neck of the bottle.

Now, in order to be able to use also lower-grade qualities of cork for the long-term storage of bottle wines and the like, it is obvious that the fatty acid content should be increased by a suitable impregnation operation. It will be appreciated in that respect that such an impregnation operation would have to be carried out with substances which are repellent in respect of aqueous solutions and which in regard to their sealing effect and in regard to their compatibility with the material in the bottle, must be comparable or identical to the substances which are repellent in respect of aqueous solutions, as are found naturally in the cork. Therefore, the impregnation material must be required to be non-volatile, acceptable from the point of view of the laws relating to foodstuffs, tasteless and odorless, and it must also not react chemically with the bottled material, inasmuch such reactions would give rise to compounds which would not comply with the requirements in respect of compatibility.

Unfortunately, hitherto cork has successfully resisted all pertinent impregnation processes. It was only possible to achieve an impregnation effect on the surface of the cork or in regions of the cork which are at any event close to the surface thereof, amounting to only fractions of a millimeter. Accordingly, such a surface impregnation process could hitherto not achieve any substantial improvement in the sealing action of a cork in a bottle.

SUMMARY OF THE INVENTION

An object of the present invention is to provide a cork impregnation process that can provide an improved impregnation effect.

Another object of the present invention is to provide a process for impregnating a cork in such a way as to improve the sealing effect thereof, using an aqueous solution-repellent substance, in such a way that a cork can be reliably impregnated to any desired depth, to the desired extent.

Yet another object of the present invention is to provide a cork impregnation process which can give an improved and quicker impregnation effect. Still another object of the present invention is to provide a bottle cork impregnation process that gives an improved impregnation effect using simple operating steps.

In accordance with the principles of the present invention, these and other objects are achieved by a process for impregnating a bottle cork, to improve the sealing effect thereof, with at least one substance which is repellent in respect of aqueous solutions, such as wines and spirits, and which in regard to its sealing effect and in regard to compatibility with the bottled material is comparable to or identical to the aqueous solution-repellent substance or substances that are to be found naturally in cork, wherein, prior to the step of impregnating the cork, the cork is exposed on its surface at which the impregnation effect is to be applied, to a corona discharge such as: a direct current corona discharge after DC power source from an electrode connected to either the positive or negative pole of the DC power source an alternating current corona discharge.

It was surprisingly found that when the cork to be impregnated is subjected to a preliminary treatment of the above-indicated kind, prior to the impregnation step, the cork absorbs the impregnation agent or agents used, more particularly to the respectively desired depth which may be controlled by way of the duration and the strength of the corona discharge, the length of the impregnation period and the viscosity of the impregnation agent or agents.

PREFERRED EMBODIMENTS

In the interests of minimizing the amount of impregnation agent or agents used, it is sufficient for the corks to be impregnated only on the side which subsequently is towards the material to be stoppered by use of the cork.

It will be appreciated that the corona discharge should not be taken to such a degree that the electrical dielectric or breakdown strength of the cork is exceeded. Dielectric breakdowns would destroy the cork structure. Accordingly, advantageous operating voltage values for the corona discharge phenomenon are up to 500 kV, more particularly from 20 to 40 kV and advantageously from 25 to 31 kV. A preferred voltage value is 28 kV.

In the interests of providing a treatment effect which is uniform over a large area, it is recommended that the corona discharge step be carried out by means of a corona discharge electrode which is of a bar configuration or a grid or lattice configuration, with for example a conveyor belt having the corks disposed thereon passing beneath the electrode. A blast or blowing action on the corks during corona discharge in the region affected thereby renders the effect thereof on the surfaces of the cork still more uniform. The spacing of the electrode from the surface of the cork to be treated is advantageously set to up to 150 mm, more particularly from 2 to 60 mm, advantageously from 5 to 30 mm. The electrode spacing varies in direct proportion to corona discharge operating voltages, that is to say larger electrode spacings are associated with higher corona discharge operating voltages, and vice-versa, in order to ensure that dielectric breakdowns do not occur. Treating the surface of the cork with a corona discharge for a period of up to 30 seconds, in particular up to 16 seconds and preferably from 2 to 8 seconds, has been found to be satisfactory. In that connection, the length of the treatment time is increased in proportion to decreasing corona discharge operating voltages and increasing specific weights of cork, that is to say, longer treatment times are associated with lower corona discharge operating voltages and higher specific weights of the cork, and vice-versa.

Excessively long treatment times are in part uneconomical and in part they result in such a substantial alteration in the structure of the cork that the cork begins to suck up the impregnation agent, in particular an impregnation agent of low viscosity, like a sponge, and allows it completely to ooze or seep away in its interior. It was found that optimum values in respect of the depth of impregnation and the resulting enrichment in respect of substances that repel aqueous solutions to that depth are between 1 and 4 mm, preferably between 2 and 3 mm.

Particularly good results are achieved when operating with an alternating current corona discharge. Suitable operating frequencies are up to 500 kHz, in particular from 50 Hz to 50 kHz, preferably from 15 to 25 kHz and advantageously from 18 to 22 kHz.

Preferably, the impregnation step is effected directly following the corona discharge treatment as the change in structure of the cork produced by the corona discharge disappears again in about one to two weeks and the cork returns to its non-impregnable condition. On touching the corks and the like, the change in structure of the cork due to the corona discharge disappears really quickly.

The impregnation operation is preferably performed using at least one of the following substances:

saturated and unsaturated fatty acids which occur naturally in cork, in optionally esterified or saponified form, primary alcohols having from 20 to 26 carbon atoms and alkanes having from 16 to 34 carbon atoms, and natural and synthetic oils and fats and silicone oils and fats, for example dimethyl polysiloxane (including emulsions thereof) with a melting point of not more than 90° C. and a kinematic viscosity of up to 30,000 $mm^2/s$, in particular from 50 to 700 $mm^2/s$, advantageously from 100 to 350 $mm^2/s$, at impregnation temperatures.

The impregnation temperatures are determined by the melting point of the respective impregnation agent or agents used and the respectively desired viscosity.

Directly after their corona discharge treatment, the corks are impregnated for a period of preferably 2 to 60 seconds, in particular from 5 to 30 seconds, using a dip or spray process. In that operation, the viscosity values of the impregnation liquid increase in proportion to increasing impregnation times, that is to say, higher viscosity values of the impregnation liquid are associated with increased impregnation times and vice-versa. The impregnation times may be shortened by carrying out the impregnation operation at elevated pressure.

After the impregnation operation, the cork is advantageously also subjected to a drying operation using air at elevated temperature, advantageously at 40° C. or less.

When dealing with corks which are of lower specific weights, it is recommended that the steps of the process comprising exposing the corks to corona discharge, impregnating the corks and drying the corks should be repeated at least once in order in this case also to achieve the desired level of enrichment of the corks with one or more substances which are repellent to aqueous solutions.

It should be noted that a lubricant is frequently used when corking bottles in filling plants in order to take account of the high operating speeds involved, for example of 15,000 units per hour. As a lubricant on a silicone base is also a water-repellent substance, such lubricant may also be utilized for impregnation purposes, in which case there is no need for a separate treatment of the cork with a lubricant.

It will be appreciated that the preferred forms of the steps of the process according to the invention have been set forth by way of example thereof and that various modifications and alterations may be made therein without departing from the spirit and scope of the invention.

I claim:

1. A process for impregnating a cork for a bottle containing an alcoholic drink to improve the long term sealing effect of said cork with said bottle, said process comprising spacing a generally uniform sealing surface of said cork a predetermined distance of up to 150mm from a corona discharge electrode; exposing said sealing surface of said cork to a corona discharge of predetermined voltage having a maximum of 500 KV for a period up to 30 seconds; and impregnating said cork to a predetermined depth of between 1mm and 4mm by contact with at least one aqueous solution repelling substance compatible with said alcoholic drink in said bottle selected from the group consisting of saturated and unsaturated fatty acids which occur naturally in cork, primary alcohols having 20 to 26 carbon atoms, alkanes having 16 to 34 carbon atoms, and fats and oils with a melting point not more than 90° C. and a kinematic viscosity of up to 30,000 $mm^2$/sec at impregnation step temperature; said impregnating step occuring prior to the cork returning to its non-impregnable condition and said contact with said aqueous solution repelling substance occuring for a length of time of between 2 and 60 seconds.

2. The process as set forth in claim 1 wherein said predetermined voltage is from 20 to 40 kV.

3. The process as set forth in claim 1 wherein said predetermined voltage is from 25 to 31 kV.

4. The process as set forth in claim 1 wherein said predetermined voltage is substantially 28 kV.

5. The process as set forth in claim 1 wherein said corona discharge is produced by a corona discharge electrode having a bar configuration.

6. The process as set forth in claim 1 wherein said corona discharge is produced by a corona discharge electrode having a grid configuration.

7. The process as set forth in claim 5 wherein said exposing step further comprises treating said cork with a blast action.

8. The process as set forth in claim 6 wherein said exposing step further comprises treating said cork with a blast action.

9. The process as set forth in claim 1 wherein said predetermined distance is from 2 to 60 mm.

10. The process as set forth in claim 1 wherein said predetermined distance is from 5 to 30 mm.

11. The process as set forth in claim 1 wherein said predetermined period of time is a period of up to 30 seconds, the length of said period of time increasing in proportion to decreasing said predetermined voltage and increasing said specific weight of said cork.

12. The process as set forth in claim 11 wherein the length of said predetermined period of time is up to 16 seconds.

13. The process as set forth in claim 11 wherein the length of said predetermined period is from 2 to 8 seconds.

14. The process as set forth in claim 1 wherein said corona discharge is formed by alternating current having a frequency of up to 500 kHz.

15. The process as set forth in claim 14 wherein said frequency is up from 50 Hz to 50 kHz.

16. The process as set forth in claim 14 wherein said frequency is from 15 to 25 kHz.

17. The process as set forth in claim 14 wherein said frequency is from 18 to 22 kHz.

18. The process as set forth in claim 1 wherein the aqueous solution repelling substance is said saturated or unsaturated fatty acids in their esterified or saponified form.

19. The process as set forth in claim 1 wherein said oils and fats include dimethylpolysiloxane.

20. The process as set forth in claim 1 wherein said kinematic viscosity is from 50 to 700 $mm^2$/s.

21. The process as set forth in claim 1 wherein said kinematic viscosity is from 100 to 350 $mm^2$/s.

22. The process as set forth in claim 1 wherein the impregnation step is carried out at a predetermined elevated pressure.

23. The process as set forth in claim 1 wherein said impregnating step occurs directly after said exposing step, said period of time being from 2 to 60 seconds, with kinematic viscosity being proportional to said period of time.

24. The process as set forth in claim 23 wherein the length of said period of time is from 5 to 30 seconds.

25. The process as set forth in claim 23 wherein said impregnation step comprises a dip process.

26. The process as set forth in claim 23 wherein said impregnation step comprises a spray process.

27. The process as set forth in claim 1 wherein after the impregnation step said process comprises drying said cork in air at an elevated temperature.

28. The process as set forth in claim 27 wherein said elevated temperature is a maximum of 40° C.

29. The process as set forth in claim 27 wherein the steps comprising exposing said cork to corona discharge, impregnating said cork and drying said cork are repeated at least once on any said cork having a low specific weight.

30. The process as set forth in claim 1 wherein said corona discharge is provided by an electrode connected to a positive pole of a DC power source.

31. The process as set forth in claim 1 wherein said corona discharge is provided by an electrode connected to a negative pole of a DC power source.

32. A cork for sealing a bottle containing fluid, made by the process of claim 1.

* * * * *